US007404889B1

(12) United States Patent
Powers

(10) Patent No.: US 7,404,889 B1
(45) Date of Patent: Jul. 29, 2008

(54) HYDROCARBON THERMAL CRACKING USING ATMOSPHERIC DISTILLATION

(75) Inventor: Donald H. Powers, Houston, TX (US)

(73) Assignee: Equistar Chemicals, LP, Houston, TX (US)

( * ) Notice: Subject to any disclaimer, the term of this patent is extended or adjusted under 35 U.S.C. 154(b) by 0 days.

(21) Appl. No.: 11/823,187

(22) Filed: Jun. 27, 2007

(51) Int. Cl.
*C10G 9/00* (2006.01)
*C10G 9/36* (2006.01)
*C10B 55/00* (2006.01)
*C07C 4/02* (2006.01)

(52) U.S. Cl. ..... 208/106; 208/50; 208/53; 208/54; 208/130; 585/648; 585/652

(58) Field of Classification Search ..... 208/106, 208/50, 53, 54, 59, 67, 68, 72, 73, 80, 130, 208/230, 92, 105; 585/648, 652, 921
See application file for complete search history.

(56) References Cited

U.S. PATENT DOCUMENTS

| | | | | | |
|---|---|---|---|---|---|
| 2,415,998 | A * | 2/1947 | Foster | 208/61 |
| 4,426,278 | A * | 1/1984 | Kosters | 208/130 |
| 4,885,080 | A * | 12/1989 | Brown et al. | 208/218 |
| 5,107,060 | A * | 4/1992 | Yan | 585/823 |
| 5,167,795 | A * | 12/1992 | Gartside | 208/67 |
| 5,228,978 | A * | 7/1993 | Taylor et al. | 208/89 |
| 5,326,465 | A * | 7/1994 | Yongqing et al. | 208/120.15 |
| 5,635,055 | A * | 6/1997 | Sweet et al. | 208/99 |
| 6,117,305 | A * | 9/2000 | Bando et al. | 208/39 |
| 6,365,792 | B1 * | 4/2002 | Stapf et al. | 585/539 |
| 6,743,961 | B2 | 6/2004 | Powers | 585/648 |
| 6,979,757 | B2 | 12/2005 | Powers | 585/648 |
| 7,019,187 | B2 | 3/2006 | Powers | 585/648 |
| 7,029,571 | B1 * | 4/2006 | Bhattacharyya et al. | 208/76 |
| 2004/0004022 | A1 * | 1/2004 | Stell et al. | 208/106 |
| 2004/0004028 | A1 * | 1/2004 | Stell et al. | 208/130 |
| 2005/0209495 | A1 * | 9/2005 | McCoy et al. | 585/648 |
| 2005/0261533 | A1 * | 11/2005 | Stell et al. | 585/648 |
| 2005/0261534 | A1 * | 11/2005 | Stell et al. | 585/648 |
| 2005/0261536 | A1 * | 11/2005 | Stell et al. | 585/648 |
| 2005/0261538 | A1 * | 11/2005 | Stell | 585/648 |
| 2006/0014992 | A1 * | 1/2006 | Stell et al. | 585/648 |
| 2006/0014993 | A1 * | 1/2006 | Stell et al. | 585/648 |
| 2006/0014994 | A1 * | 1/2006 | Keusenkothen | 585/648 |
| 2006/0089519 | A1 * | 4/2006 | Stell et al. | 585/648 |
| 2006/0129012 | A1 * | 6/2006 | Frye et al. | 585/648 |
| 2006/0213810 | A1 * | 9/2006 | Stell et al. | 208/130 |
| 2006/0249428 | A1 * | 11/2006 | Stell et al. | 208/130 |
| 2007/0049783 | A1 * | 3/2007 | Stell et al. | 585/648 |
| 2007/0055087 | A1 | 3/2007 | Powers | 585/648 |
| 2007/0208207 | A1 | 9/2007 | Powers | 585/648 |

OTHER PUBLICATIONS

Co-pending U.S. Appl. No. 11/584,722, filed Oct. 20, 2006.

* cited by examiner

*Primary Examiner*—Walter D. Griffin
*Assistant Examiner*—Huy-Tram Nguyen
(74) *Attorney, Agent, or Firm*—Roderick W. MacDonald

(57) ABSTRACT

A method for thermally cracking a hydrocarbonaceous feed wherein the feed is first processed in an atmospheric thermal distillation step to form a light gasoline and atmospheric residuum mixture. The light gasoline/residuum combination is gasified at least in part in a vaporization step, and the gasified product of the vaporization step is thermally cracked.

11 Claims, 2 Drawing Sheets

HYDROCARBON THERMAL CRACKING USING ATMOSPHERIC DISTILLATION

BACKGROUND OF THE INVENTION

1. Field of the Invention

This invention relates to the thermal cracking of hydrocarbons using an atmospheric thermal distillation tower in combination with a vaporization unit that feeds at least one thermal cracking furnace.

2. Description of the Prior Art

Thermal cracking (pyrolysis) of hydrocarbons is a petrochemical process that is widely used to produce olefins such as ethylene, propylene, butenes, butadiene, and aromatics such as benzene, toluene, and xylenes.

Basically, a hydrocarbon containing feedstock is mixed with steam which serves as a diluent to keep the hydrocarbon molecules separated. The steam/hydrocarbon mixture is preheated in the convection zone of the furnace to from about 900 to about 1,000 degrees Fahrenheit (F), and then enters the reaction (radiant) zone where it is very quickly heated to a severe hydrocarbon thermal cracking temperature in the range of from about 1,400 to about 1,550 F. Thermal cracking is accomplished without the aid of any catalyst.

This process is carried out in a pyrolysis furnace (steam cracker) at pressures in the reaction zone ranging from about 10 to about 30 psig. Pyrolysis furnaces have internally thereof a convection section (zone) and a separate radiant section (zone). Preheating functions are primarily accomplished in the convection section, while severe cracking mostly occurs in the radiant section.

After thermal cracking, depending on the nature of the primary feed to the pyrolysis furnace, the effluent from that furnace can contain gaseous hydrocarbons of great variety, e.g., from one to thirty-five carbon atoms per molecule. These gaseous hydrocarbons can be saturated, monounsaturated, and polyunsaturated, and can be aliphatic, alicyclics, and/or aromatic. The cracked gas can also contain significant amounts of molecular hydrogen (hydrogen).

The cracked product is then further processed in the olefin production plant to produce, as products of the plant, various separate individual streams of high purity such as hydrogen, ethylene, propylene, mixed hydrocarbons having four carbon atoms per molecule, fuel oil, and pyrolysis gasoline. Each separate individual stream aforesaid is a valuable commercial product in its own right. Thus, an olefin production plant currently takes a part (fraction) of a whole crude stream or condensate, and generates there from a plurality of separate, valuable products.

Thermal cracking came into use in 1913, and was first applied to gaseous ethane as the primary feed to the cracking furnace for the purpose of making ethylene. Since that time the industry has evolved to using heavier and more complex hydrocarbonaceous gaseous and/or liquid feeds as the primary feed for the cracking furnace. Such feeds can now employ a fraction of whole crude or condensate which is essentially totally vaporized while thermally cracking same. The cracked product can contain, for example, about 1 weight percent (wt. %) hydrogen, about 10 wt. % methane, about 25 wt. % ethylene, and about 17 wt. % propylene, all wt. % being based on the total weight of that product, with the remainder consisting mostly of other hydrocarbon molecules having from 4 to 35 carbon atoms per molecule.

Natural gas and whole crude oil(s) were formed naturally in a number of subterranean geologic formations (formations) of widely varying porosities. Many of these formations were capped by impervious layers of rock. Natural gas and whole crude oil (crude oil) also accumulated in various stratigraphic traps below the earth's surface. Vast amounts of both natural gas and/or crude oil were thus collected to form hydrocarbon bearing formations at varying depths below the earth's surface. Much of this natural gas was in close physical contact with crude oil, and, therefore, absorbed a number of lighter molecules from the crude oil.

When a well bore is drilled into the earth and pierces one or more of such hydrocarbon bearing formations, natural gas and/or crude oil can be recovered through that well bore to the earth's surface.

The terms "whole crude oil" and "crude oil" as used herein means liquid (at normally prevailing conditions of temperature and pressure at the earth's surface) crude oil as it issues from a wellhead separate from any natural gas that may be present, and excepting any treatment such crude oil may receive to render it acceptable for transport to a crude oil refinery and/or conventional distillation in such a refinery. This treatment would include such steps as desalting. Thus, it is crude oil that is suitable for distillation or other fractionation in a refinery, but which has not undergone any such distillation or fractionation. It could include, but does not necessarily always include, non-boiling entities such as asphaltenes or tar. As such, it is difficult if not impossible to provide a boiling range for whole crude oil. Accordingly, whole crude oil could be one or more crude oils straight from an oil field pipeline and/or conventional crude oil storage facility, as availability dictates, without any prior fractionation thereof.

Natural gas, like crude oil, can vary widely in its composition as produced to the earth's surface, but generally contains a significant amount, most often a major amount, i.e., greater than about 50 weight percent (wt. %), methane. Natural gas often also carries minor amounts (less than about 50 wt. %), often less than about 20 wt. %, of one or more of ethane, propane, butane, nitrogen, carbon dioxide, hydrogen sulfide, and the like. Many, but not all, natural gas streams as produced from the earth can contain minor amounts (less than about 50 wt. %), often less than about 20 wt. %, of hydrocarbons having from 5 to 12, inclusive, carbon atoms per molecule (C5 to C12) that are not normally gaseous at generally prevailing ambient atmospheric conditions of temperature and pressure at the earth's surface, and that can condense out of the natural gas once it is produced to the earth's surface. All wt. % are based on the total weight of the natural gas stream in question.

When various natural gas streams are produced to the earth's surface, a hydrocarbon composition often naturally condenses out of the thus produced natural gas stream under the then prevailing conditions of temperature and pressure at the earth's surface where that stream is collected. There is thus produced a normally liquid hydrocarbonaceous condensate separate from the normally gaseous natural gas under the same prevailing conditions. The normally gaseous natural gas can contain methane, ethane, propane, and butane. The normally liquid hydrocarbon fraction that condenses from the produced natural gas stream is generally referred to as "condensate," and generally contains molecules heavier than butane (C5 to about C20 or slightly higher). After separation from the produced natural gas, this liquid condensate fraction is processed separately from the remaining gaseous fraction that is normally referred to as natural gas.

Thus, condensate recovered from a natural gas stream as first produced to the earth's surface is not the exact same material, composition wise, as natural gas (primarily methane). Neither is it the same material, composition wise, as crude oil. Condensate occupies a niche between normally gaseous natural gas and normally liquid whole crude oil. Condensate contains hydrocarbons heavier than normally gaseous natural gas, and a range of hydrocarbons that are at the lightest end of whole crude oil.

Condensate, unlike crude oil, can be characterized by way of its boiling point range. Condensates normally boil in the range of from about 100 to about 650 F. With this boiling range, condensates contain a wide variety of hydrocarbonaceous materials. These materials can include compounds that make up fractions that are commonly referred to as naphtha, kerosene, diesel fuel(s), and gas oil (fuel oil, furnace oil, heating oil, and the like).

Naphtha and associated lighter boiling materials (naphtha) are in the C5 to C10, inclusive, range, and are the lightest boiling range fractions in condensate, boiling in the range of from about 100 to about 400 F.

Petroleum middle distillates (kerosene, diesel, atmospheric gas oil) are generally in the C10 to about C20 or slightly higher range, and generally boil, in their majority, in the range of from about 350 to about 650 F. They are, individually and collectively, referred to herein as "distillate," "distillates," or "middle distillates." Distillate compositions can have a boiling point lower than 350 F and/or higher than 650 F, and such distillates are included in the 350-650 F range aforesaid, and in this invention. Atmospheric residuum (resid or residua) typically boils at a temperature of from about 650 F up to its end boiling point where only non-boiling entities such as asphaltenes and tar are left. Atmospheric resid is formed by processing crude oil/condensate in an atmospheric thermal distillation tower. Atmospheric resid is not the same as vacuum residuum which is formed in a vacuum assisted thermal distillation tower, and has a boiling range of from about 1,000 F up to its end boiling point where only non-boiling entities remain.

The olefin production industry is now progressing beyond the use of fractions of crude oil or condensate (gaseous and/or liquid) as the primary feed for a cracking furnace to the use of whole crude oil and/or condensate itself.

Recently, U.S. Pat. No. 6,743,961 (hereafter "USP'961") issued to Donald H. Powers. This patent relates to cracking whole crude oil by employing a vaporization/mild cracking zone that contains packing. This zone is operated in a manner such that the liquid phase of the whole crude that has not already been vaporized is held in that zone until cracking/vaporization of the more tenacious hydrocarbon liquid components is maximized. This allows only a minimum of solid residue formation which residue remains behind as a deposit on the packing. This residue is later burned off the packing by conventional steam air decoking, ideally during the normal furnace decoking cycle, see column 7, lines 50-58 of that patent. Thus, the second zone 9 of that patent serves as a trap for components, including hydrocarbonaceous materials, of the crude oil feed that cannot be cracked or vaporized under the conditions employed in the process, see column 8, lines 60-64 of that patent.

Still more recently, U.S. Pat. No. 7,019,187 issued to Donald H. Powers. This patent is directed to the process disclosed in U.S. Pat. No. '961, but employs a mildly acidic cracking catalyst to drive the overall function of the vaporization/mild cracking unit more toward the mild cracking end of the vaporization (without prior mild cracking)-mild cracking (followed by vaporization) spectrum.

U.S. Pat. No. 6,979,757 to Donald H. Powers is directed to the process disclosed in U.S. Pat. No. '961, but that invention removes at least part of the liquid hydrocarbons remaining in the vaporization/mild cracking unit that are not yet vaporized or mildly cracked. These liquid hydrocarbon components of the crude oil feed are drawn from near the bottom of that unit and passed to a separate controlled cavitation device to provide additional cracking energy for those tenacious hydrocarbon components that have previously resisted vaporization and mild cracking. Thus, that invention also seeks to drive the overall process in the vaporization/mild cracking unit more toward the mild cracking end of the vaporization-mild cracking spectrum aforesaid.

The disclosures of the foregoing patents, in their entirety, are incorporated herein by reference.

U.S. patent application Ser. No. 11/219,166, filed Sep. 2, 2005, having common inventorship and assignee with U.S. Pat. No. '961, is directed to the process of using whole crude oil as the feedstock for an olefin plant to produce a mixture of hydrocarbon vapor and liquid. The vaporous hydrocarbon is separated from the remaining liquid and the vapor passed to a severe cracking operation. The remaining liquid is vaporized using a quench oil to minimize coke forming reactions.

U.S. patent application Ser. No. 11/365,212, filed Mar. 1, 2006, having common inventorship and assignee with U.S. Pat. No. '961, is directed to the use of condensate as the dominant liquid hydrocarbonaceous feed for the vaporization unit and furnace.

U.S. patent application Ser. No. 11/584,722, filed Oct. 20, 2006, having common inventorship and assignee with U.S. Pat. No. '961, is directed to the integration of the vaporization unit/furnace combination with a crude oil refinery.

During periods of increased gasoline demand, the gasoline supply (pool) can be increased by subjecting various crude oil fractions, including distillates, to various refinery catalytic cracking processes such as fluid catalytic cracking. Thus, the quantity of gasoline/naptha produced from a barrel of crude oil can be increased if desired. This is not so with distillates as defined above. The amount of distillate recovered from a barrel of crude oil is fixed and cannot be increased as it can with gasoline. The only way to increase distillate production to increase the distillate supply for the distillate pool is by refining additional barrels of crude oil.

By this invention valuable distillates that are in short supply are saved for the distillate pool, and not consumed in the cracking process.

SUMMARY OF THE INVENTION

In accordance with this invention, there is provided a unique combination of an atmospheric thermal distillation tower operated in combination with a vaporization unit/cracking furnace system.

DETAILED DESCRIPTION OF THE INVENTION

Figure 1:
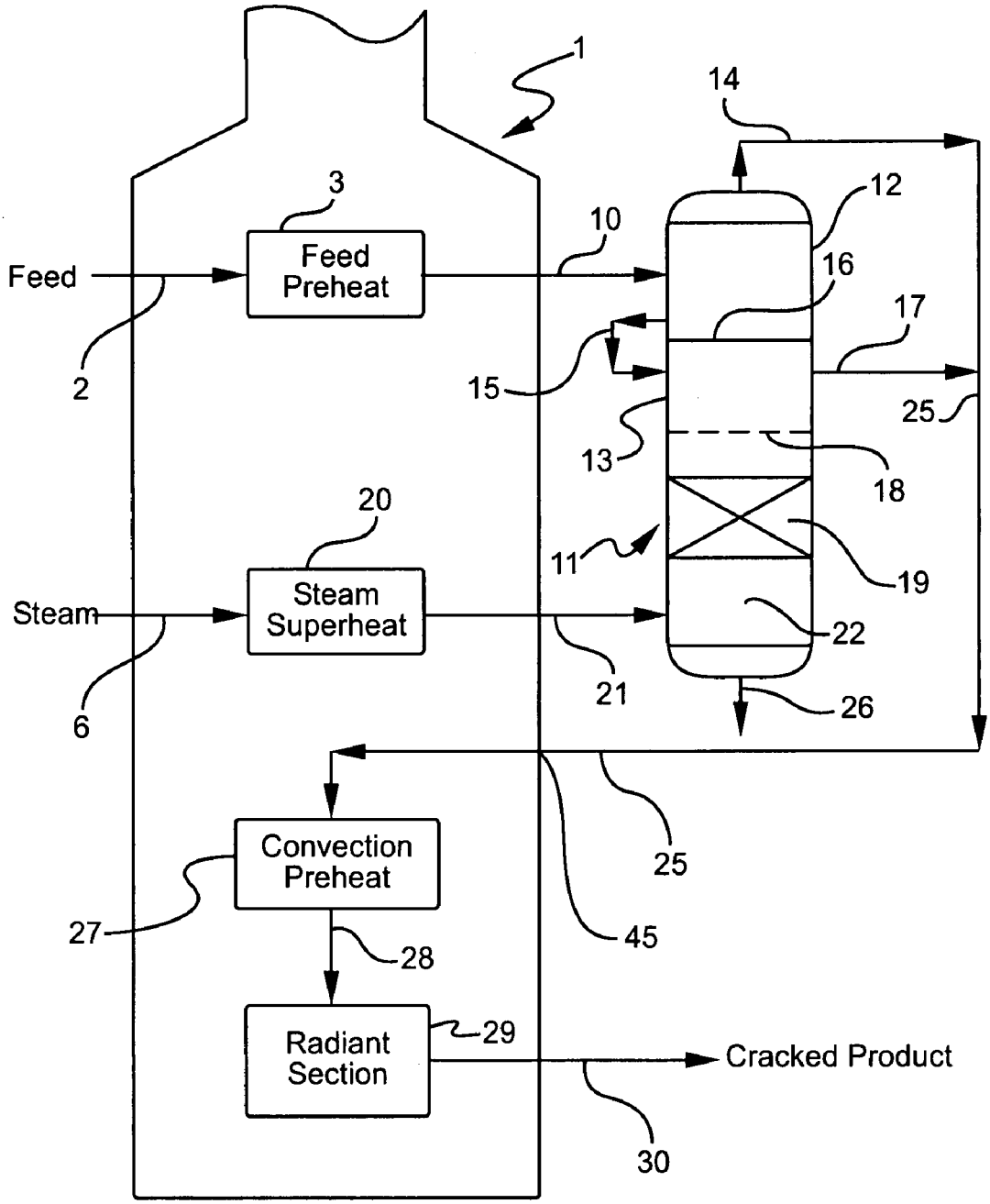
FIG. 1 Prior Art
FIG. 1 shows a simplified flow sheet for the whole crude oil/condensate vaporization/cracking process described hereinabove.

The terms "hydrocarbon," "hydrocarbons," and "hydrocarbonaceous" as used herein do not mean materials strictly or only containing hydrogen atoms and carbon atoms. Such terms include materials that are hydrocarbonaceous in nature in that they primarily or essentially are composed of hydrogen and carbon atoms, but can contain other elements such as oxygen, sulfur, nitrogen, metals, inorganic salts, and the like, even in significant amounts.

The term "gaseous" as used in this invention means one or more gases in an essentially vaporous state, for example, steam alone, a mixture of steam and hydrocarbon vapor, and the like.

Coke, as used herein, means a high molecular weight carbonaceous solid, and includes compounds formed from the condensation of polynuclear aromatics.

An olefin producing plant useful with this invention would include a pyrolysis (thermal cracking) furnace for initially receiving and thermally cracking the feed. Pyrolysis furnaces for steam cracking of hydrocarbons heat by means of convection and radiation, and comprise a series of preheating, circulation, and cracking tubes, usually bundles of such tubes, for preheating, transporting, and cracking the hydrocarbon feed. The high cracking heat is supplied by burners disposed in the radiant section (sometimes called "radiation section") of the furnace. The waste gas from these burners is circulated through the convection section of the furnace to provide the heat necessary for preheating the incoming hydrocarbon feed. The convection and radiant sections of the furnace are joined at the "cross-over," and the tubes referred to hereinabove carry the hydrocarbon feed from the interior of one section to the interior of the next.

In a typical furnace, the convection section can contain multiple sub-zones. For example, the feed can be initially preheated in a first upper sub-zone, boiler feed water heated in a second sub-zone, mixed feed and steam heated in a third sub-zone, steam superheated in a fourth sub-zone, and the final feed/steam mixture split into multiple sub-streams and preheated in a lower (bottom) or fifth sub-zone. The number of sub-zones and their functions can vary considerably. Each sub-zone can carry a plurality of conduits carrying furnace feed there through, many of which are sinusoidal in configuration. The convection section operates at much less severe operating conditions than the radiant section.

Cracking furnaces are designed for rapid heating in the radiant section starting at the radiant tube (coil) inlet where reaction velocity constants are low because of low temperature. Most of the heat transferred simply raises the hydrocarbons from the inlet temperature to the reaction temperature. In the middle of the coil, the rate of temperature rise is lower but the cracking rates are appreciable. At the coil outlet, the rate of temperature rise increases somewhat but not as rapidly as at the inlet. The rate of disappearance of the reactant is the product of its reaction velocity constant times its localized concentration. At the end of the coil, reactant concentration is low and additional cracking can be obtained by increasing the process gas temperature.

Steam dilution of the feed hydrocarbon lowers the hydrocarbon partial pressure, enhances olefin formation, and reduces any tendency toward coke formation in the radiant tubes.

Cracking furnaces typically have rectangular fireboxes with upright tubes centrally located between radiant refractory walls. The tubes are supported from their top.

Firing of the radiant section is accomplished with wall or floor mounted burners or a combination of both using gaseous or combined gaseous/liquid fuels. Fireboxes are typically under slight negative pressure, most often with upward flow of flue gas. Flue gas flow into the convection section is established by at least one of natural draft or induced draft fans.

Radiant coils are usually hung in a single plane down the center of the fire box. They can be nested in a single plane or placed parallel in a staggered, double-row tube arrangement. Heat transfer from the burners to the radiant tubes occurs largely by radiation, hence the term "radiant section," where the hydrocarbons are heated to from about 1,400 F to about 1,550 F and thereby subjected to severe cracking, and coke formation.

The initially empty radiant coil is, therefore, a fired tubular chemical reactor. Hydrocarbon feed to the furnace is preheated to from about 900 F to about 1,000 F in the convection section by convectional heating from the flue gas from the radiant section, steam dilution of the feed in the convection section, or the like. After preheating, in a conventional commercial furnace, the feed is ready for entry into the radiant section.

The cracked gaseous hydrocarbons leaving the radiant section are rapidly reduced in temperature to prevent destruction of the cracking pattern. Cooling of the cracked gases before further processing of same downstream in the olefin production plant recovers a large amount of energy as high pressure steam for re-use in the furnace and/or olefin plant. This is often accomplished with the use of transfer-line exchangers that are well known in the art.

With a liquid hydrocarbon feedstock downstream processing, although it can vary from plant to plant, typically employs an oil quench of the furnace effluent after heat exchange of same in, for example, the transfer-line exchanger aforesaid. Thereafter, the cracked hydrocarbon stream is subjected to primary fractionation to remove heavy liquids, followed by compression of uncondensed hydrocarbons, and acid gas and water removal there from. Various desired products are then individually separated, e.g., ethylene, propylene, a mixture of hydrocarbons having four carbon atoms per molecule, fuel oil, pyrolysis gasoline, and a high purity hydrogen stream.

FIG. 1 shows a vaporization/cracking system that can operate on whole crude oil and/or condensate as the dominant (primary) system feed. FIG. 1 is very diagrammatic for sake of simplicity and brevity since, as discussed above, actual furnaces are complex structures.

FIG. 1 shows a liquid cracking furnace 1 wherein a crude oil/condensate primary feed 2 is passed into an upper feed preheat sub-zone 3 in the upper, cooler reaches of the convection section of furnace 1. Steam 6 is also superheated in an upper level of the convection section of the furnace.

The pre-heated cracking feed stream is then passed by way of pipe (line) 10 to a vaporization unit 11 (fully disclosed in U.S. Pat. No. '961), which unit is separated into an upper vaporization zone 12 and a lower vaporization zone 13. This unit 11 achieves primarily (predominately) vaporization of at least a significant portion of the naphtha and gasoline boiling range and lighter materials that remain in the liquid state after the pre-heating step 3. Gaseous materials that are associated with the preheated feed as received by unit 11, and additional gaseous materials formed in zone 12, are removed from zone 12 by way of line 14. Thus, line 14 carries away essentially all the lighter hydrocarbon vapors, e.g., naphtha and gasoline boiling range and lighter, that are present in zone 12. Liquid distillate present in zone 12, with or without some liquid gasoline and/or naphtha, is removed therefrom via line 15 and passed into the upper interior of lower zone 13. Zones 12 and 13, in this embodiment, are separated from fluid communication with one another by an impermeable wall 16, which can be a solid tray. Line 15 represents external fluid down flow communication between zones 12 and 13. In lieu thereof, or in addition thereto, zones 12 and 13 can have internal fluid communication there between by modifying wall 16 to be at least in part liquid permeable by use of one or more trays designed to allow liquid to pass down into the interior of zone 13 and vapor up into the interior of zone 12. For example, instead of an impermeable wall 16, a chimney tray could be used in which case liquid within unit 11 would flow internally down into section 13 instead of externally of unit 11 via line 15. In this internal down flow case, distributor 18 becomes optional.

By whatever way liquid is removed from zone 12 to zone 13, that liquid moves downwardly into zone 13, and thus can encounter at least one liquid distribution device 18. Device 18 evenly distributes liquid across the transverse cross section of unit 11 so that the liquid will flow uniformly across the width of the tower into contact with packing 19.

Dilution steam 6 passes through superheat zone sub-20, and then, via line 21 in to a lower portion 22 of zone 13 below packing 19. In packing 19 liquid and steam from line 21 intimately mix with one another thus vaporizing some of liquid 15. This newly formed vapor, along with dilution steam 21, is removed from zone 13 via line 17 and added to the vapor in line 14 to form a combined hydrocarbon vapor product in line 25. Stream 25 can contain essentially hydrocarbon vapor from feed 2, e.g., gasoline, naphtha, middle distillates, gas oils, and steam.

Stream 17 thus represents a part of feed stream 2 plus dilution steam 21 less hydrocarbon residue from feed 2 that are present in bottoms stream 26. Stream 25 is passed through a header (not shown) whereby stream 25 is split into multiple sub-streams and passed through multiple conduits (not shown) into convection section pre-heat sub-zone 27 of furnace 1. Section 27 is in a lower, and therefore hotter, section of furnace 1. Section 27 is used for preheating stream 25 to a temperature, aforesaid, suitable for cracking in radiant zone 29.

After substantial heating in section 27, stream 25 passes by way of line 28 into radiant section 29. Again, the multiple, individual streams that normally pass from sub-zone 27 to and through zone 29 are represented as a single flow stream 28 for sake of brevity.

In radiant firebox 29 of furnace 1, feed from line 28, which contains numerous varying hydrocarbon components, is subjected to severe thermal cracking conditions as aforesaid.

The cracked product leaves radiant firebox 29 by way of line 30 for further processing in the remainder of the olefin plant downstream of furnace 1 as described hereinabove and shown in detail in USP'961.

When using crude oil and/or condensate as the significant component(s) of feed 2, substantial amounts of distillates are ultimately passed into furnace 1 and cracked thereby converting such distillates into lighter components. Accordingly, these distillates are lost as a source of distillate supply for jet fuel, diesel fuels, and home heating oils.

Feed 2 can enter furnace 1 at a temperature of from about ambient up to about 300 F at a pressure from slightly above atmospheric up to about 100 psig (hereafter "atmospheric to 100 psig"). Feed 2 can enter zone 12 via line 10 at a temperature of from about ambient to about 700 F at a pressure of from atmospheric to 100 psig.

Stream 14 can be essentially all hydrocarbon vapor formed from feed 2 and is at a temperature of from about ambient to about 700 F at a pressure of from atmospheric to 100 psig.

Stream 15 can be essentially all the remaining liquid from feed 2 less that which was vaporized in pre-heater 3 and is at a temperature of from about ambient to about 700 F at a pressure of from slightly above atmospheric up to about 100 psig (hereafter "atmospheric to 100 psig").

The combination of streams 14 and 17, as represented by stream 25, can be at a temperature of from about 600 to about 800 F at a pressure of from atmospheric, to 100 psig, and contain, for example, an overall steam/hydrocarbon ratio of from about 0.1 to about 2, preferably from about 0.1 to about 1, pounds of steam per pound of hydrocarbon.

In zone 13, dilution ratios (hot gas/liquid droplets) will vary widely because the compositions of atmospheric resid and condensate vary widely. Generally, the hot gas, e.g., steam and hydrocarbon at the top of zone 13 can be present in a ratio of steam to hydrocarbon of from about 0.1/1 to about 5/1.

Steam is an example of a suitable hot gas introduced by way of line 21. Other materials can be present in the steam employed. Stream 6 can be that type of steam normally used in a conventional cracking plant. Such gases are preferably at a temperature sufficient to volatilize a substantial fraction of the liquid hydrocarbon 15 that enters zone 13. Generally, the gas entering zone 13 from conduit 21 will be at least about 650 F, preferably from about 900 to about 1,200 F at from atmospheric to 100 psig. Such gases will, for sake of simplicity, hereafter be referred to in terms of steam alone.

Stream 17 can be a mixture of steam and hydrocarbon vapor that has a boiling point lower than about 1,200 F. Stream 17 can be at a temperature of from about 600 to about 800 F at a pressure of from atmospheric to 100 psig.

Steam from line 21 does not serve just as a diluent for partial pressure purposes as is the normal case in a cracking operation. Rather, steam from line 21 provides not only a diluting function, but also additional vaporizing and mild cracking energy for the hydrocarbons that remain in the liquid state. This is accomplished with just sufficient energy to achieve vaporization and/or mild cracking of heavier hydrocarbon components such as those found in atmospheric resid and by controlling the energy input. For example, by using steam in line 21, substantial vaporization/mild cracking of feed 2 liquid is achieved. The very high steam dilution ratio and the highest temperature steam are thereby provided where they are needed most as liquid hydrocarbon droplets move progressively lower in zone 13.

Figure 2:
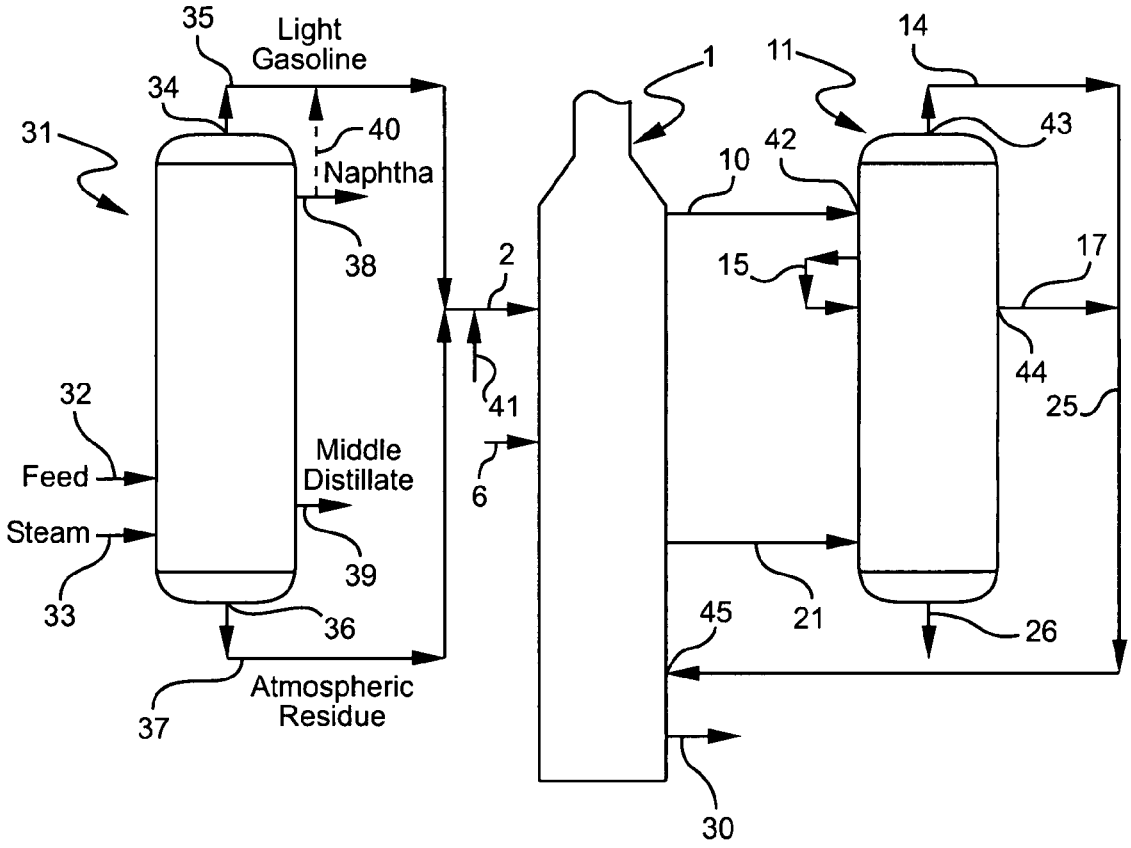
FIG. 2 shows the vaporization/cracking system of FIG. 1 in operational connection with an atmospheric distillation tower.

FIG. 2 shows, in accordance with this invention, the combination of an atmospheric thermal distillation tower 31 with the system of FIG. 1 that is composed of furnace 1 and vaporization (stripper) unit 11. Furnace 1 and stripper 11 are shown in less detail in FIG. 2 than FIG. 1 only for sake of better showing the inventive combination of this invention, i.e., a combination of atmospheric tower, furnace, and stripper. Furnace 1 and stripper 11 of FIG. 2 would be in an operational connection similar to that shown in FIG. 1. In other words, for example, feed 2 to furnace 1 in FIG. 2 could be preheated in the preheat section 3 of furnace 1 of FIG. 1, the same being true for steam 6 of FIG. 2.

Atmospheric distillation tower 31 receives crude oil/condensate feed 32, and, in a conventional manner, thermally distills feed 32 into a plurality of hydrocarbonaceous fractions. Tower 31 has an overhead outlet 34 operationally connected (in fluid communication) with line 35, and a bottoms outlet 36 operationally connected to line 37. Tower 31 is deliberately operated in a manner to produce a light gasoline fraction overhead that is carried by line 35 and a residuum bottoms fraction that is carried by line 37. Fired heaters, side strippers, condensers, pumps, reflux accumulators, and other equipment normally associated with an atmospheric thermal distillation tower are well known in the art, and are not shown for sake of clarity.

Pursuant to this invention, feed 2 to furnace 1 of FIG. 2 is not the prior art crude oil/condensate feed 2 of FIG. 1. Instead, stream 2 of FIG. 2 contains, as a significant component thereof, residuum obtained from the atmospheric thermal distillation 31 of at least one crude oil/condensate feed 32.

Although one or more atmospheric residua can be essentially the sole component of feed material 2 in FIG. 2, this invention is not so limited so long as atmospheric residuum is a significant constituent in that feed 2 and in line 10.

The atmospheric resid feed employed in this invention can be from a single or multiple sources, and, therefore, can be a single resid or a mixture of two or more residua. Atmospheric resid useful in this invention can have a wide boiling range, particularly when mixtures of residua are employed, but will generally be in a boiling range of from about 600 F to the boiling end point where only non-boiling entities remain.

Note that this invention does not apply to vacuum resid or catalytic cracking resid.

Pursuant to this invention, hydrocarbons boiling lighter (lower) than about 1,200 F, all as defined hereinabove, remaining in the atmospheric residuum feed 10 of FIG. 2 will be vaporized in unit 11 and removed by way of either line 14 or 17 or both and fed to furnace 1 as described hereinabove. In addition, hydrocarbonaceous entities heavier than the lighter entities mentioned above in this paragraph can, at least in part, be mildly cracked or otherwise broken down in unit 11 to lighter hydrocarbonaceous entities such as those mentioned above, and those just formed lighter entities removed by way of line 17 as feed for furnace 1. The remainder of the residuum feed 10 of FIG. 2, if any, is removed by way of line 26 for disposition elsewhere.

Light gasoline fractions and atmospheric residua useful in this invention can each have a wide boiling range, particularly when mixtures of light gasoline and residua are employed. However, the light gasoline fraction will generally be in a boiling range of from about the boiling point of pentane to about 158 F, while the atmospheric residua employed will have a boiling range of from about 600 F to its boiling end point with only non-boiling entities present.

Tower 31 can, if desired, also be operated to produce additional separate fractions such as one or more naphtha fractions collectively shown by way of line 38, and one or more middle distillate fractions collectively shown by way of line 39, all as defined hereinabove.

Naphtha fraction 38 can be full range naphtha, or one or more sub-fractions thereof, such as light naphtha, medium naphtha, and heavy naphtha. Pursuant to this invention, light naphtha and/or medium naphtha can be added to light gasoline feed 35 by way of line 40.

The materials in lines 35 and 37 are deliberately mixed and fed into line 2 which, after preheating in section 3 (FIG. 1) of the furnace, is operationally connected to inlet 42 of vaporization unit 11. Unit 11 is, in turn, operationally connected by way of its outlets 43 and 44 to inlet 45 of furnace 1. Accordingly tower 31, unit 11, and furnace 1 are operated in combination in a unique manner in order to produce the results of this invention.

Atmospheric resid bottoms 37 from atmospheric thermal distillation tower 31 are primarily composed of a gas oil component boiling in the range of from about 600 to about 1,000 F and a heavier fraction boiling in a temperature range of from about 1,000 F up to its end boiling point where only non-boiling entities remain. A vacuum assisted thermal distillation tower (vacuum tower) typically separates this gas oil component from its associated heavier fraction aforesaid, thus freeing the gas oil fraction for separate recovery and beneficial use elsewhere.

By the process of this invention, the need for a vacuum tower to recover the gas oil component contained in atmospheric resid is eliminated, without eliminating the function thereof. This is accomplished in this invention by using atmospheric resid as a significant portion of the feed 2 (and 10) to stripper 11 of FIG. 1. In section 13 of stripper 11 the counter current flow of downward moving hydrocarbon liquid and upward flowing steam 21 enables the heaviest (highest boiling point) liquids to be contacted at the highest steam to oil ratio and with the highest temperature steam at the same time. This creates an efficient operation for the vaporization and mild cracking of the atmospheric resid thereby forming additional lighter materials from that resid, and freeing the gas oil component of that resid, all for recovery by way of line 17 as additional cracking feed for furnace 1. It can be seen that this invention utilizes for breaking down atmospheric resid, energy in stripper 11 that is normally utilized in the operation of furnace 1, while eliminating the energy cost of operating a separate vacuum tower. Similarly the capital and other costs for a vacuum tower are eliminated without loss of the function of that vacuum tower in breaking down atmospheric resid and separating the useful gas oil component thereof.

The amount of atmospheric resid employed in feed 2 pursuant to this invention can be a significant component of the overall feed 2. The atmospheric resid component can be at least about 20 wt. % of the total weight of feed 2, but it is not necessarily strictly within this range.

Depending on the specific physical and chemical characteristics of the atmospheric resid added to feed 2, other materials can be added to that feed at 41. Such additional materials can include light gasoline, naphtha, natural gasoline and/or condensate. Naphtha can be employed in the form of full range naphtha, light naphtha, medium naphtha, heavy naphtha, or mixtures of two or more thereof. The light gasoline can have a boiling range of from that of pentane (C5) to about 158 F. Full range naphtha, which includes light, medium, and heavy naphtha fractions, can have a boiling range of from about 158 to about 350 F. The boiling ranges for the light, medium, and heavy naphtha fractions can be, respectively, from about 158 to about 212 F, from about 212 to about 302 F, and from about 302 to about 350 F.

If light materials, as aforesaid, are added to the atmospheric resid in feed 2, it can be preferable, again depending on the specific characteristics of this resid feed in line 2, that lighter fractions such as light gasoline and light naphtha be added to that resid feed, thereby leaving medium and/or heavy naphtha fractions for addition to the gasoline pool.

The amount of light material(s) thus deliberately added to the atmospheric resid in feed 2 can vary widely depending on the desires of the operator, but the resid in feed 2 will remain a significant component of the feed 2 that is in line 10 that feeds vaporization unit 11.

The deliberate re-mixing of already separated light materials 35 with atmospheric resid 37 is counter intuitive in the art, and not practiced in the art. However, the addition of one or more of these light materials to the atmospheric resid is highly useful in this invention because they help lift the gas oil from the atmospheric resid in stripper 11.

Depending on the characteristics of the resid in line 2, the amount of residua added to line 2, and present in line 10, after addition of one or more light materials thereto as aforesaid, can be less than 20 wt. % and still be within the spirit of this invention.

It can be seen, that, with this invention, the distillates that are removed by atmospheric tower 31 are preserved for separate use such as for diesel fuel and kerosene, and a novel combination of atmospheric resid and lighter material is used as feed in stripper 11 to form additional cracking feedstock from atmospheric resid that would otherwise be lost for this purpose.

EXAMPLE

A conventional atmospheric distillation unit 31 is operated at a bottom temperature of about 650 F and atmospheric pressure using Saharan Blend crude oil as the feed 32 to this unit.

A Saharan Blend atmospheric residuum 37 is mixed in equal parts by weight with light gasoline 35 and naphtha 38, and fed into the preheat section 3 of the convection section of pyrolysis furnace 1. This feed mixture 2 is at 260 F and 80 psig. In this convection section feed 2 is preheated to about 690 F at about 60 psig, and then passed through line 10 into vaporization unit 11 wherein a mixture of gasoline, naphtha and gas oil gases at about 690 F and 60 psig is separated in zone 12 of that unit.

These separated gases are removed from zone 12 for transfer by way of line 25 to the convection preheat sub-zone 27 of the same furnace.

The hydrocarbon liquid remaining from residuum feed 2, after separation from accompanying hydrocarbon gases aforesaid, is transferred to lower section 13 and allowed to fall downwardly in that section toward the bottom thereof. Preheated steam 21 at about 1,050 F is introduced near the bottom of zone 13 to give a steam to hydrocarbon ratio in section 13 of about 1. The falling liquid droplets are in counter current flow with the steam that is rising from the bottom of zone 13 toward the top thereof. With respect to the liquid falling downwardly in zone 13, the steam to liquid hydrocarbon ratio increases from the top to bottom of section 19.

A mixture of steam and vapor 17 which contains the gas oil fraction at about 760 F is withdrawn from near the top of zone 13 and mixed with the gases earlier removed from zone 12 via line 14 to form a composite steam/hydrocarbon vapor stream 25 containing about 0.4 pounds of steam per pound of hydrocarbon present. This composite stream is preheated in sub-zone 27 to about 1,000 F at less than about 50 psig, and then passed into radiant firebox 29 for cracking at a temperature in the range of 1,400° F. to 1,550° F.

Bottoms product 26 of unit 11 is removed at a temperature of about 900 F, and pressure of about 60 psig, and passed to the downstream processing equipment to produce fuel oil therefrom.

I claim:

1. In a method for thermally cracking a hydrocarbonaceous feed in at least one stand alone cracking furnace wherein said feed is first subjected to a vaporization step in a stand alone vaporization unit in which unit a substantial portion of said feed is vaporized and the vapors thus formed are removed from said vaporization unit and passed to said at least one cracking furnace as the feed for said furnace, the improvement comprising subjecting at least one of whole crude oil and condensate to at least one atmospheric thermal distillation step in a stand alone atmospheric distillation tower to form at least a light gasoline overhead fraction and a separate residuum fraction containing gas oil, and passing at least part of said thus formed light gasoline and residuum fractions in combination as feed to said vaporization step.

2. The method of claim 1 wherein said vaporization step employs at least first and second vaporization zones, said first vaporization zone receives said light gasoline/residuum combination from said atmospheric thermal distillation step and separates gaseous materials associated with said combination as received and any additional gaseous materials formed in said first vaporization zone, said separated gaseous materials are passed from said first vaporization zone to said at least one cracking furnace as feed therefore, said second vaporization zone receives from said first vaporization zone liquid remainder of said combination that was not vaporized in said first vaporization zone and subjects said liquid remainder to at least one of heating and mild cracking in said second vaporization zone until a significant amount of said liquid combination in said second zone is vaporized, and the gaseous materials formed in said second zone are removed therefrom and passed to said at least one cracking furnace as feed therefore.

3. The method of claim 2 wherein said gaseous materials from said first and second vaporization zones are passed to the same cracking furnace.

4. The method of claim 1 wherein said light gasoline boils in the range of from about the boiling point of pentane to about 158 F, and said residuum has a boiling range of from about 650 F to its boiling end point.

5. The method of claim 1 wherein condensate is added to said light gasoline and residuum combination before said combination is fed to said vaporization step.

6. The method of claim 1 wherein at least one of light naphtha, medium naphtha, heavy naphtha, and middle distillate are formed by said distillation step, and at least one of said light naphtha and said medium naphtha is added to said light gasoline/residuum combination that is fed to said vaporization step.

7. The method of claim 6 wherein said light naphtha boils in the range of from about 158 to about 212 F, said medium naphtha boils in the range of from about 212 to about 302 F, and said heavy naphtha boils in a range of from about 302 to about 350 F.

8. The method of claim 7 wherein said middle distillate mixture is employed to form at least one of kerosene and diesel fuel.

9. The method of claim 7 wherein said middle distillate boils in the range of from about 350 to about 650 F.

10. The method of claim 1 wherein said combination of light gasoline overhead fraction and residuum fraction is at least 20 wt. % of the total weight of said feed to said vaporization step.

11. A method for employing a stand alone atmospheric distillation tower, a separate stand alone vaporization unit, and at least one separate stand alone thermal cracking furnace in a hydrocarbonaceous thermal cracking process, said distillation tower, vaporization unit, and cracking furnace each being physically separate from one another, said method comprising first atmospherically distilling at least one of whole crude oil and condensate in said distillation tower to form there from at least a light gasoline fraction and a separate atmospheric residuum fraction containing gas oil, removing the thus formed light gasoline fraction and atmospheric residuum fraction from said distillation tower, deliberately combining at least part of said light gasoline and atmospheric residuum fractions that were just removed from said distillation tower to form a mixture thereof, passing said thus formed mixture of light gasoline and atmospheric residuum fractions into said vaporization unit, substantially vaporizing said mixture in said vaporization unit, passing at least part of said removed vapors into said at least one cracking furnace, and therein thermally cracking said vapors.

* * * * *